US011279147B2

(12) United States Patent
Akiyama et al.

(10) Patent No.: US 11,279,147 B2
(45) Date of Patent: Mar. 22, 2022

(54) DECURLING DEVICE AND IMAGE FORMING APPARATUS

(71) Applicant: FUJIFILM BUSINESS INNOVATION CORP., Tokyo (JP)

(72) Inventors: Shingo Akiyama, Kanagawa (JP); Nobuyoshi Komatsu, Kanagawa (JP); Shogo Kamiya, Kanagawa (JP); Seiji Taira, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 61 days.

(21) Appl. No.: 16/930,818

(22) Filed: Jul. 16, 2020

(65) Prior Publication Data

US 2021/0300066 A1 Sep. 30, 2021

(30) Foreign Application Priority Data

Mar. 26, 2020 (JP) ..... JP2020-055330

(51) Int. Cl.
*B41J 11/00* (2006.01)
*G03G 15/00* (2006.01)

(52) U.S. Cl.
CPC ..... *B41J 11/0005* (2013.01); *B41J 11/007* (2013.01); *G03G 15/6529* (2013.01)

(58) Field of Classification Search
CPC .. B41J 11/0005; B41J 11/007; G03G 15/6529
See application file for complete search history.

(56) References Cited

U.S. PATENT DOCUMENTS 7,298,981 B2 * 11/2007 Oohara ..... G03G 15/2028 399/322
2016/0355029 A1 * 12/2016 Kondo ..... B41J 2/01

FOREIGN PATENT DOCUMENTS

JP 05341601 A * 12/1993
JP 2004309820 A * 11/2004
JP 3993312 B2 * 10/2007
JP 2016-164644 A 9/2016

* cited by examiner

*Primary Examiner* — Sharon Polk
(74) *Attorney, Agent, or Firm* — Oliff PLC

(57) ABSTRACT

A decurling device includes: a first transporter including a transport roller, the first transporter that sandwiches a transported sheet and transports the transported sheet further downstream; and a second transporter including an endless belt that is in contact with the transport roller. The transport roller has an elasticity that, when the belt is pressed against the transport roller, allows the belt to bite into the transport roller by a bite amount corresponding to a pressing force, the second transporter includes an abutting member disposed inside the belt, the abutting member includes an upstream protrusion, an downstream protrusion, the upstream protrusion and the downstream protrusion being provided at positions away from each other at an upstream portion and a downstream portion in a sheet transport direction.

20 Claims, 7 Drawing Sheets

DECURLING DEVICE AND IMAGE FORMING APPARATUS

CROSS-REFERENCE TO RELATED APPLICATIONS

This application is based on and claims priority under 35 USC 119 from Japanese Patent Application No. 2020-055330 filed Mar. 26, 2020.

BACKGROUND

1. Technical Field

The present disclosure relates to a decurling device and an image forming apparatus.

2. Related Art

There are decurling devices that remove curl in a sheet that is curled due to, for example, image formation, by causing the sheet to pass through a contact portion where two members are in contact with each other. If a device that remove upward curl and a device that remove downward curl are provided separately, the size of an image forming apparatus increases. JP-A-2016-164644 proposes one decurling device that can remove both curls in different orientations.

SUMMARY

A decurling device is required to have a transport capability that allows a sheet to smoothly pass through the decurling device without causing a transport failure.

Aspects of non-limiting embodiments of the present disclosure relates to providing (i) a decurling device having an improved transport capability as compared with a decurling device that has a structure in which a nip area is formed by pressing both an upstream portion and a downstream portion of the nip area against a counterpart element, and (ii) an image forming apparatus including the decurling device.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a decurling device including: a first transport unit including a transport roller, the first transport unit that sandwiches a transported sheet and transports the transported sheet further downstream; and a second transport unit including an endless belt that is in contact with the transport roller. The transport roller has an elasticity that, when the belt is pressed against the transport roller, allows the belt to bite into the transport roller by a bite amount corresponding to a pressing force, the second transport unit includes an abutting member disposed inside the belt, the abutting member includes an upstream protrusion, an downstream protrusion, the upstream protrusion and the downstream protrusion being provided at positions away from each other at an upstream portion and a downstream portion in a sheet transport direction, each of the upstream protrusion and the downstream protrusion protruding toward an inner surface of the belt, and a recess provided in an intermediate portion between the upstream protrusion and the downstream protrusion in the sheet transport direction, the recess being recessed away from a straight line connecting a top portion of the upstream protrusion and a top portion of the downstream protrusion, the abutting member presses the belt from the inner surface of the belt and causes the belt to abut against the transport roller, a downstream pressed portion of the belt pressed by the downstream protrusion is in contact with the transport roller, and an upstream pressed portion of the belt pressed by the upstream protrusion is separated from the belt.

BRIEF DESCRIPTION OF THE DRAWINGS

Exemplary embodiment(s) of the present disclosure will be described in detail based on the following figures, wherein.

DETAILED DESCRIPTION

Hereinafter, exemplary embodiments of the present disclosure will be described.

Figure 1:
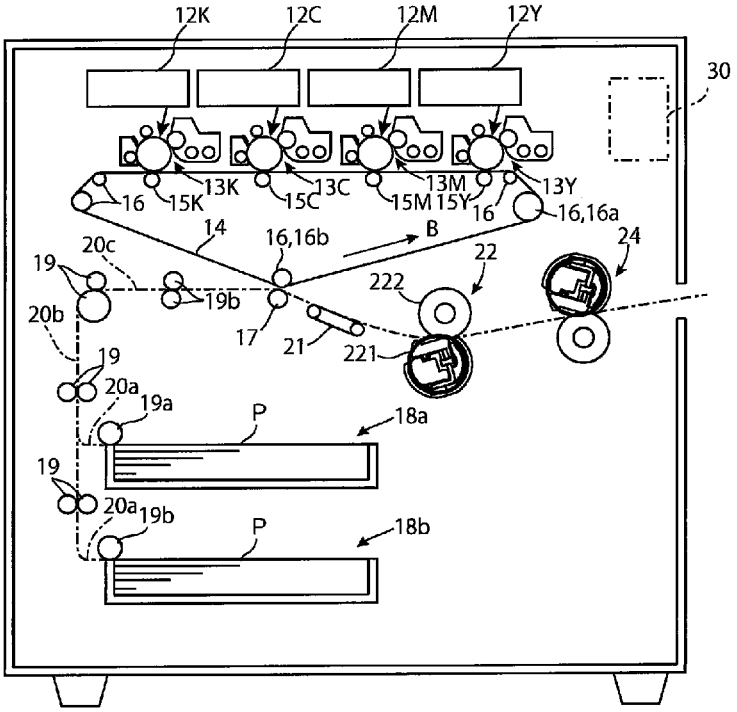
FIG. 1 is a schematic configuration diagram of an image forming apparatus according to an exemplary embodiment of the present disclosure.

FIG. 1 is a schematic configuration diagram of an image forming apparatus according to an exemplary embodiment of the present disclosure. The image forming apparatus includes a decurling device according to an exemplary embodiment of the present disclosure.

An image forming apparatus 10 includes a housing 11. Each member constituting the image forming apparatus 10 is provided in the housing 11.

The image forming apparatus 10 has a configuration in which an image is formed using toners of four colors. Four exposure units 12Y, 12M, 12C, 12K and four image forming units 13Y, 13M, 13C, 13K are provided in the housing 11.

Herein, alphabets in reference numerals represent the colors of the toners used for development. Among the alphabets, Y represents yellow, M represents magenta, C represents cyan, and K represents black.

Hereinafter, when it is not necessary to distinguish the colors, the alphabets indicating the colors may be omitted, the reference numeral "12" is simply assigned to the exposure units, and the reference numeral "13" is simply assigned to the image forming units. When it is necessary to distinguish the colors, the reference numerals each followed by a respective one of the above-described alphabets representing the colors will be used. The same applies to elements other than the exposure units 12 and the image forming units 13.

Figure 2:
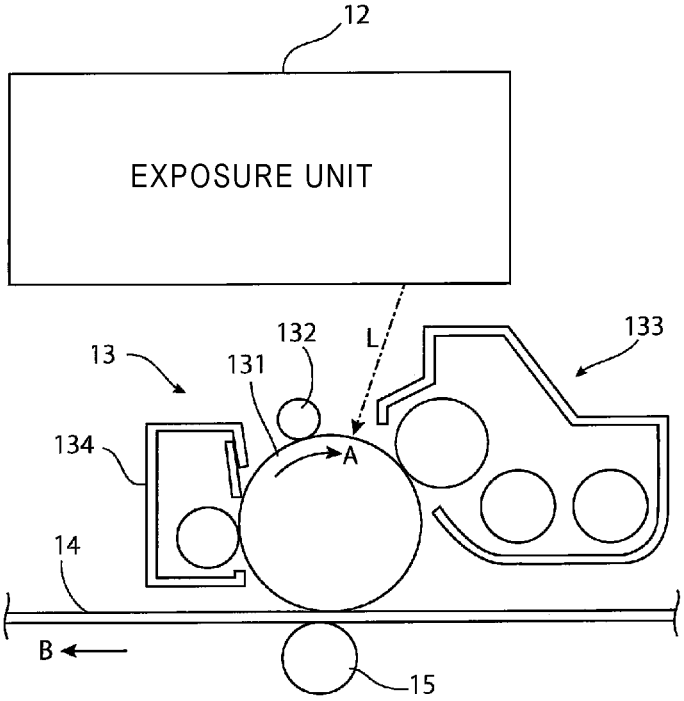
FIG. 2 is a schematic diagram showing a configuration around one image forming unit.

FIG. 2 is a schematic diagram showing a configuration around one image forming unit.

The image forming unit 13 includes a drum image carrier 131 that rotates in a direction of an arrow A. A charging unit 132, a developing unit 133, and a cleaner 134 are disposed around the image carrier 131. The exposure unit 12 is disposed above the image carrier 131. Furthermore, a primary transfer member 15 is disposed at a position where an intermediate transfer belt 14 (which will be described later) is sandwiched between the image carrier 131 and the primary transfer member 15.

The image carrier 131 is charged by the charging unit 132 while rotating in the direction of the arrow A, and is exposed to an exposure beam L emitted from the exposure unit 12. The exposure unit 12 repeatedly scans the image carrier 131 with the exposure beam L modulated according to image data in a direction perpendicular to the sheet of FIG. 2, and form an electrostatic latent image by the repeated scanning of the exposure beam L on the image carrier 131. The electrostatic latent image is developed by the developing unit 133 that accommodates a developer containing a toner and a carrier with the toner in the developer, so that a toner image is formed on the image carrier 131. The toner is supplied from a toner cartridge (not shown) so that a predetermined amount of toner is stored in the developing unit 133. The toner image formed on the image carrier 131 by an action of the developing unit 133 is transferred onto the intermediate transfer belt 14 that is moved in a direction of an arrow B by an action of the primary transfer member 15 that is applied with a transfer bias.

The toner remaining on the image carrier 131 after the transfer is removed from the image carrier 131 by the cleaner 134.

Returning to FIG. 1, the description will be continued.

The endless intermediate transfer belt 14 is provided below the four image forming units 13. The intermediate transfer belt 14 is supported by plural rollers 16 including a driving roller 16*a* and a backup roller 16*b*. The intermediate transfer belt 14 is circularly moved in the direction of the arrow B while being in contact with each of the image carriers 131 constituting the image forming units 13.

A secondary transfer member 17 is provided at a position where the secondary transfer member 17 faces the backup roller 16*b* with the intermediate transfer belt 14 interposed between the secondary transfer member 17 and the backup roller 16*b*. The toner images which are sequentially transferred onto the intermediate transfer belt 14 in a superimposed manner by the action of the primary transfer members 15 provided corresponding to the image forming units 13 are further transported in the direction of the arrow B by the intermediate transfer belt 14. The toner images on the intermediate transfer belt 14 are secondarily transferred, by the action of the secondary transfer member 17, onto a sheet transported to a position sandwiched between the intermediate transfer belt 14 and the secondary transfer member 17. As a result, an unfixed toner image is formed on the sheet.

Two sheet accommodating units 18*a* and 18*b* are provided in a lower part of the housing 11. A large number of sheets P are stored in the sheet accommodating units 18*a* and 18*b* in a stacked state, respectively. During image formation, the sheet P is taken out from the sheet accommodating units 18*a* and 18*b*.

When the image is formed, the uppermost sheet among the sheets P accommodated in one of the sheet accommodating units 18*a* and 18*b*, which is designated automatically or manually by an operator, is taken out by a pickup roller 19*a*. Then, the one sheet is transported by a transport roller 19 onto transport paths 20*a*, 20*b*, and 20*c*, and a leading end of the transported sheet reaches a registration roller 19*b*. The registration roller 19*b* corrects a posture of the transported sheet, adjusts subsequent timing at which the sheet is fed, and further feeds the sheet downstream in a transport direction.

The registration roller 19*b* feeds the sheet such that the sheet is transported to the position of the secondary transfer member 17 in accordance with timing at which the toner image on the intermediate transfer belt 14 is transported to the position of the secondary transfer member 17.

The sheet on which the toner image is transferred by the action of the secondary transfer member 17 is transported by a transport belt 21 and reaches a fixing unit 22. The fixing unit 22 includes a heating belt 221 and a pressure roller 222. The sheet transported to the fixing unit 22 is sandwiched between the heating belt 221 and the pressure roller 222 to be heated and pressurized, and the toner image on the sheet is fixed to the sheet. The sheet passing through the fixing unit 22 further reaches a decurler 24, and a warp of the sheet is removed by the decurler 24. Here, the decurler 24 is an example of a decurling device of the present disclosure.

The sheet passing through the decurler 24 is discharged to an outside of the housing 11.

An image processor and controller 30 is provided on an upper part of the image forming apparatus 10. The image processor and controller 30 includes a memory that stores image data and the like transmitted from the outside, a calculation circuit that performs various processing such as image processing on the image data, and a control circuit that controls the entire image forming apparatus 10.

Here, the description of the overall image forming apparatus is completed. The decurler 24 which is a theme of the present exemplary embodiment will be described below.

Figure 3:
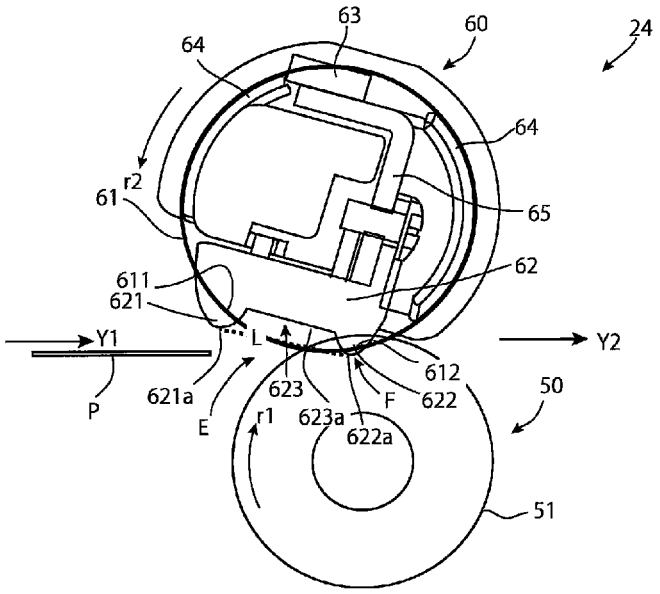
FIG. 3 is a schematic diagram of a decurler incorporated in the image forming apparatus shown in FIG. 1.

FIG. 3 is a schematic diagram of the decurler incorporated in the image forming apparatus shown in FIG. 1.

The decurler 24 includes a first transport unit 50 and a second transport unit 60. The first transport unit 50 includes a transport roller 51. The transport roller 51 rotates in a direction of an arrow r1. The second transport unit 60 includes an endless decurler belt 61 that is in contact with the transport roller 51. The decurler belt 61 rotates in a direction of an arrow r2 following the rotation of the transport roller 51 in the direction of the arrow r1. The first transport unit 50 and the second transport unit 60 sandwich the sheet P transported in a direction of an arrow Y1 between the transport roller 51 and the decurler belt 61, and further transport the sheet P downstream as shown by an arrow Y2.

Here, the transport roller 51 has an elasticity that, when the decurler belt 61 is pressed against the transport roller 51, allows the decurler belt 61 to bite into the transport roller 51 by a bite amount corresponding to a pressing force.

The second transport unit includes an abutting member 62, a felt 63, right and left guide members 64, and a support member 65 that supports the abutting member 62, the felt 63, and the right and left guide members 64. The abutting member 62, the felt 63, the right and left guide members 64, and the support member 65 are disposed inside the decurler belt 61.

The abutting member 62 presses the decurler belt 61 from an inner surface of the decurler belt 61, and causes the decurler belt 61 to abut against the transport roller 51.

The felt 63 is impregnated with a lubricant. The felt 63 is in contact with the inner surface of the decurler belt 61 to apply the lubricant, thereby smoothing a movement of the decurler belt 61.

Outer surfaces of the right and left guide members 64, which are contact surfaces with the decurler belt 61, have an arc shape. Extrapolation of the outer surfaces of the right and left guide members 64 forms one cylindrical shape. The right and left guide members 64 are in contact with the inner surface of the decurler belt 61 and define a part of a circulation track of the decurler belt 61 such that a portion of the decurler belt 61 in contact with the guide members 64 is maintained in the cylindrical shape. It is noted that a portion of the decurler belt 61 other than the portion in contact with the guide members 64 is pressed from the inner surface of the decurler belt 61 by the abutting member 62 and the felt 63 and thus has a deformed shape different from the cylindrical shape.

Here, each of FIG. 3 and subsequent drawings shows that the abutting member 62 and the felt 63 are in a state of protruding from the decurler belt 61. This is because the decurler belt 61 is shown in the cylindrical shape (circular shape in the drawing) obtained by extrapolating the guide members 64. Actually, the decurler belt 61 is pushed by the abutting member 62 and the felt 63, and is deformed such that the abutting member 62 and the felt 63 are located inside the decurler belt 61. The felt 63 is also pressed by the decurler belt 61 and is partially compressed. The abutting member 62 is a hard member that is hardly compressed and contributes to the deformation of the decurler belt 61.

The abutting member 62 has an upstream protrusion 621 and a downstream protrusion 622. The upstream protrusion 621 and the downstream protrusion 622 are provided at positions away from each other at an upstream portion and a downstream portion in a sheet transport direction. The upstream protrusion 621 and the downstream protrusion 622 protrude toward the inner surface of the decurler belt 61. The abutting member 62 has a recess 623. The recess 623 is provided in an intermediate portion between the upstream protrusion 621 and the downstream protrusion 622 in the sheet transport direction. The recess 623 is recessed away from a straight line L connecting a top portion 621*a* of the upstream protrusion 621 and a top portion 622*a* of the downstream protrusion 622. In the present exemplary embodiment, a bottom surface 623*a* of the recess 623 is formed in a flat surface.

Furthermore, a downstream pressed portion 612 pressed by the downstream protrusion 622 of the decurler belt 61 contacts the transport roller 51 so as to bite into the transport roller 51. An upstream pressed portion 611 pressed by the upstream protrusion 621 of the decurler belt 61 is separated from the decurler belt 61.

A curl in the sheet P transported in the direction of the arrow Y1 is removed by the decurler 24. The curl in the sheet P that is curled downward convexly is removed at a portion of the decurler belt 61 along the abutting member 62, that is, a portion of the decurler belt 61 along the upstream protrusion 621, the downstream protrusion 622, and further the recess 623 between the upstream protrusion 621 and the downstream protrusion 622, of the abutting member 62. On the other hand, the curl in the sheet P that is curled upward convexly is removed at a portion of the decurler belt 61 that is pressed by the downstream protrusion 622 so as to bite into the transport roller 51. How much the curl in the sheet is removed changes depending on the bite amount. Therefore, the decurler 24 can remove either of the downward convex curl and the upward convex curl in the sheet P by adjusting the bite amount.

For the decurler 24, in addition to a capability to remove a curl in a sheet, a sheet transport capability needs to be taken into account. That is, it is necessary to stably maintain a high sheet transport capability without causing sheet jam even when the bite amount is changed. Here, the upstream pressed portion 611 of the decurler belt 61 pressed by the upstream protrusion 621 is separated from the decurler belt 61, and a gap E is formed at a portion through which the sheet P enters the decurler 24. When the gap E is large, a contact length of the portion of the decurler belt 61 along the abutting member 62 in the sheet transport direction with respect to the entering sheet P is decreased, and the sheet transport capability deteriorates. In other words, when the gap E is small, the contact length of the portion of the decurler belt 61 along the abutting member 62 in the sheet transport direction with respect to the entering sheet P is increased, and the sheet transport capability is improved. On the other hand, with regard to the bite amount, the larger the bite amount is, the higher the sheet transport capability is, and the lower the bite amount is, the lower the sheet transport capability is.

Therefore, in order to maintain a stable sheet transport capability even when the bite amount is changed to adjust the capability to remove a curl in a sheet, the second transport unit 60 may be movable relatively to the first transport unit 50 such that the upstream gap E is widened when the bite amount by which the decurler belt 61 pressed by the downstream protrusion 622 of the abutting member 62 bites into the transport roller 51 is increased, that is, such that the upstream gap E is narrowed when the bite amount by which the decurler belt 61 pressed by the downstream protrusion 622 of the abutting member 62 bites into the transport roller 51 is decreased. Hereinafter, an adjustment of the posture or the position of the second transport unit 60 that realizes this will be described.

Figure 4A:
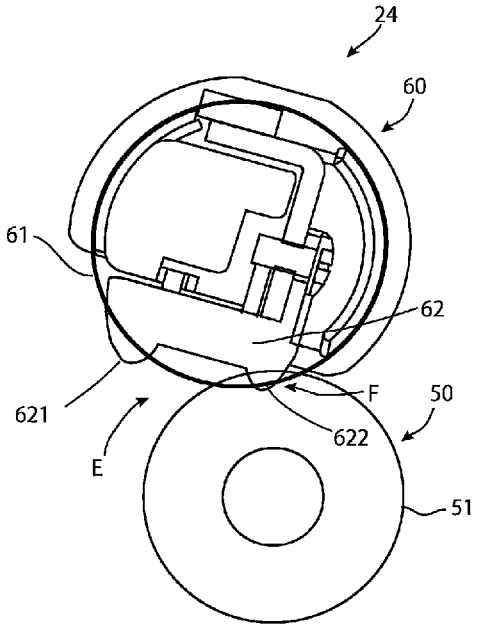
FIG. 4A is the same diagram as FIG. 3.
Figure 4B:
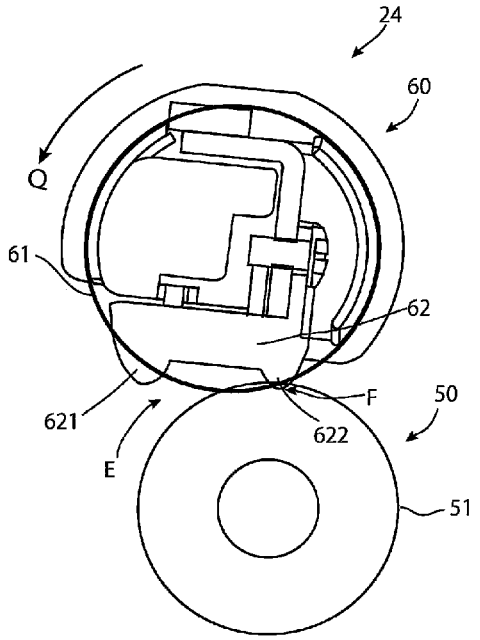
FIG. 4B is a schematic diagram showing the decurler which includes a first transport unit and a second transport unit whose posture with respect to the first transport unit is changed.

FIG. 4A is the same diagram as FIG. 3. FIG. 4B is a schematic diagram showing the decurler 24 which includes the first transport unit 50 and the second transport unit 60 whose posture with respect to the first transport unit 50 is changed. Specifically, FIG. 4B shows a state in which the posture of the second transport unit 60 is changed relatively to the first transport unit 50 in a direction of an arrow Q that is the rotation direction of the decurler belt 61, as compared with FIG. 4A. The second transport unit 60 is rotatable relatively to the first transport unit 50 by a rotation mechanism (not shown). The posture of the second transport unit 60 is adjusted depending on the orientation of the curl in the sheet P, the strength of the curl, a thickness of the sheet P, and the like.

In FIG. 4B, as compared with FIG. 4A, a bite amount F decreases, and the gap E is widened. As a result, a stable transport capability is achieved in both states shown in FIGS. 4A and 4B.

The gap E is always formed at the portion through which the sheet P enters the decurler 24 even when the posture of the second transport unit 60 is changed. Accordingly, as compared with a decurler having a structure in which not only the portion of the decurler belt 61 pressed by the downstream protrusion 622 but also the portion of the decurler belt 61 pressed by the upstream protrusion 621 is pressed against the transport roller 51 to form a nip area, the sheet is easily guided to between the transport roller 51 and the decurler belt 61, and the sheet transport capability is improved.

In the present exemplary embodiment, the decurler belt 61 is a belt made of a polyimide. As a result, the sheet transport capability is improved as compared with a belt having a higher elastic modulus than that of the polyimide.

Figure 5A:
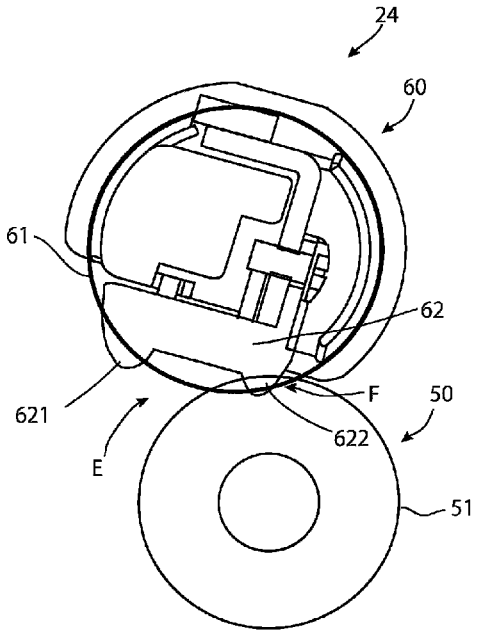
FIG. 5A is the same diagram as FIG. 3.
Figure 5B:
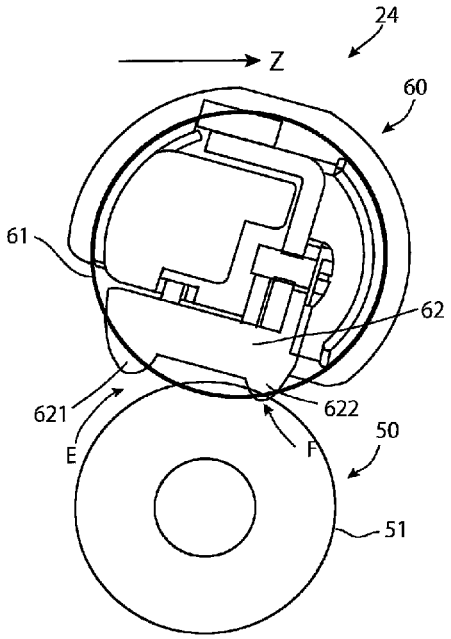
FIG. 5B is a schematic diagram showing the decurler which includes the first transport unit and the second transport unit whose position with respect to the first transport unit is changed.

FIG. 5A is the same diagram as FIG. 3. FIG. 5B is a schematic diagram showing the decurler 24 including the first transport unit 50 and the second transport unit 60 whose position with respect to the first transport unit 50 is changed. Specifically, FIG. 5B shows a state in which the position of the second transport unit 60 is changed relatively to the first transport unit 50 in a direction of an arrow Z in the sheet transport direction, as compared with FIG. 5A. The second transport unit 60 is movable relatively to the first transport unit 50 by the moving mechanism (not shown). The position of the second transport unit 60 is adjusted depending on the orientation of the curl in the sheet P, the strength of the curl, the thickness of the sheet P, and the like.

In FIG. 5B, as compared with FIG. 5A, the bite amount F decreases, and the gap E is widened. As a result, a stable transport capability is achieved in both states shown in FIGS. 5A and 5B. Improvement of the sheet transport capability is also the same as that in a case where the posture of the second transport unit 60 is changed as shown in FIG. 4.

Figure 6A:
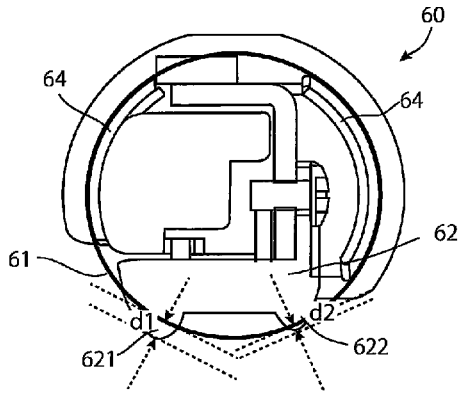
FIGS. 6A to 6C are diagrams showing shape features of an abutting member of the second transport unit from several viewpoints.
Figure 6B:
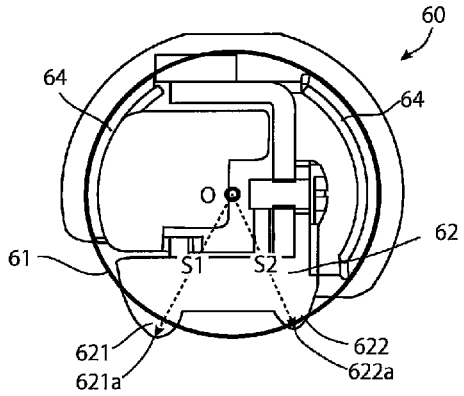
Figure 6C:
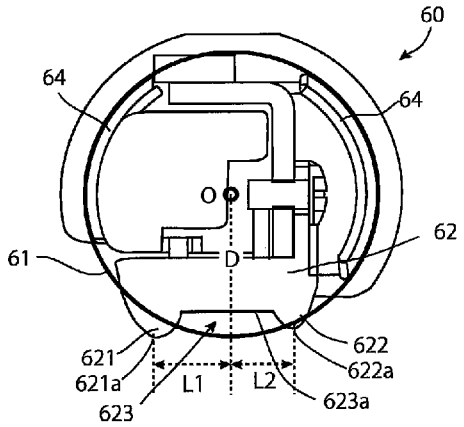

FIGS. 6A to 6C are diagrams showing shape features of the abutting member 62 of the second transport unit 60 from several viewpoints.

The decurler belt 61 is drawn in a cylindrical shape (circular shape in the drawing) obtained by extrapolating the outer surfaces of the guide members 64. Here, a circle on the drawing obtained by extrapolating the outer surfaces of the guide members 64 is referred to as a "virtual circle".

As shown in FIG. 6A, the upstream protrusion 621 of the abutting member 62 of the second transport unit 60 protrudes beyond the virtual circle by a protrusion amount d1. As a result, as compared with a case where the upstream protrusion 621 is located inside the virtual circle, the contact length of the sheet P in the sheet transport direction with the decurler belt 61 is longer, and the sheet transport capability is improved.

As shown in FIG. 6A, the downstream protrusion 622 of the abutting member 62 of the second transport unit 60 also protrudes beyond the virtual circle by a protrusion amount d2. When the downstream protrusion 622 protrudes beyond the virtual circle, the bite amount by which the downstream protrusion 622 bites into the transport roller 51 can be increased as compared with a case where the downstream protrusion 622 is located inside the virtual circle, and the sheet transport capability is improved.

As shown in FIG. 6B, both the upstream protrusion 621 and the downstream protrusion 622 protrude beyond the virtual circle, and a length S1 between a center point O of the virtual circle and the top portion 621*a* of the upstream protrusion 621 is longer than a length S2 between the center point O of the virtual circle and the top portion 622*a* of the downstream protrusion 622. Since S1>S2 as described above, it is easy to provide the decurler 24 in which the capability to remove a curl in a sheet and the sheet transport capability are balanced as compared with a case of S1<S2.

Here, the bottom surface 623*a* (see FIG. 6C) of the recess 623 between the upstream protrusion 621 and the downstream protrusion 622 of the abutting member 62 is the flat surface. As shown in FIG. 6C, a distance L1 between (i) a perpendicular line D to the bottom portion 623*a* of the recess 623 passing through the center point O of the virtual circle and (ii) the top portion 621*a* of the upstream protrusion 621 is longer than a distance L2 between (i) the perpendicular line D and (ii) the top portion 622*a* of the downstream protrusion 622. Since L1>L2 as described above, it is easy to provide the decurler 24 in which the capability to remove a curl in a sheet and the sheet transport capability are balanced as compared with a case of L1<L2.

Figure 7:
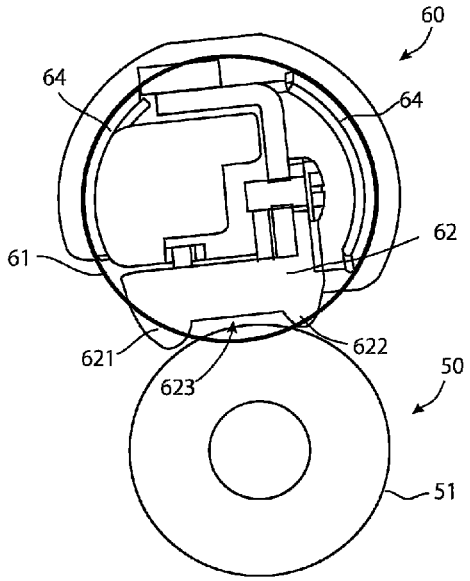
FIG. 7 is a diagram showing a relationship between the first transport unit and the second transport unit during idle time.

FIG. 7 is a diagram showing a relationship between the first transport unit 50 and the second transport unit 60 during idle time.

As shown in FIG. 7, the second transport unit 60 is operated by a separation mechanism (not shown) such that during the idle time, the bite amount by which the decurler belt 61 bites into the transport roller 51 is a smaller bite amount including zero than that during use time. As described above, since the bite amount is small during the idle time, deformation of the transport roller 51 and decurler belt 61 is reduced as compared with a case where the bite amount during the idle time remains the same as that during the use time.

In the present exemplary embodiment, the second transport unit 60 operates such that the entire abutting member 62 is separated from the transport roller 51 by a thickness of the decurler belt 61 or more during the idle time. That is, during the idle time, the decurler belt 61 is in contact with the transport roller 51 but is not pressed against the transport roller 51 by the abutting member 62. In this case, deformation of the transport roller 51 and the decurler belt 61 is reduced as compared with a case where the decurler belt 61 is pressed by the abutting member 62 during the idle time and a part of the decurler belt 61 bites into the transport roller 51.

Figure 8:
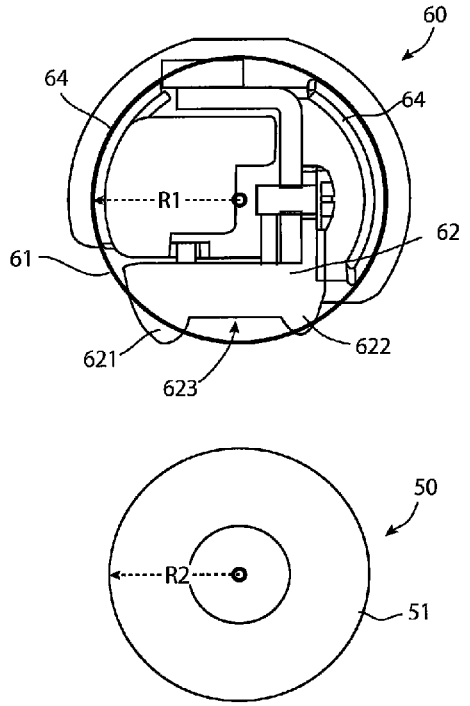
FIG. 8 is a diagram showing a comparison of circumferential lengths of a decurler belt and a transport roller.

FIG. 8 is a diagram showing a comparison of circumferential lengths of the decurler belt 61 and the transport roller 51.

In the present exemplary embodiment, when comparing a radius R1 of the virtual circle and a radius R2 of the transport roller 51, R1>R2. That is, the circumferential length of the decurler belt 61 is longer than the circumferential length of the transport roller 51. When the circumferential lengths of the decurler belt 61 and the transport roller 51 are the same, a portion of the decurler belt 61 and a portion the transport roller 51 which are in contact with each other are fixed. On the other hand, in the present exemplary embodiment, since the circumferential length of the decurler belt 61 is longer than the circumferential length of the transport roller 51, the portion of the decurler belt 61 and the portion the transport roller 51 which are in contact with each other constantly change. As a result, deformation of the transport roller 51 and the decurler belt 61 is reduced as compared with a case where the circumferential length of the transport roller 51 and the circumferential length of the decurler belt 61 are equal to each other.

In the present exemplary embodiment, the circumferential length of the decurler belt 61 is longer than the circumferential length of the transport roller 51. Conversely, when the circumferential length of the transport roller 51 is longer than the circumferential length of the decurler belt 61, the portion of the decurler belt 61 and the portion the transport roller 51 which are in contact with each other constantly change, and the deformation of the transport roller 51 and the decurler belt 61 is reduced.

According to the present exemplary embodiment described above, the decurler 24 is provided in which the capability to remove a curl in a sheet and the sheet transport capability are balanced at a high level.

Here, the example in which the decurler 24 which is an example of the decurling device of the present disclosure is applied to an image forming device shown in FIG. 1 has been described here. It is noted that the image forming apparatus of the present disclosure is not limited to the image forming device shown in FIG. 1. The decurler 24 may be applied to, for example, a monochrome image forming apparatus as it is. The image forming apparatus of the present disclosure is not only be applied to an electrophotographic image forming apparatus, but also is applicable to an image forming apparatus of other types, for example, an inkjet image forming apparatus.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A decurling device comprising:

a first transport unit comprising a transport roller, the first transport unit that sandwiches a transported sheet and transports the transported sheet further downstream; and a second transport unit comprising an endless belt that is in contact with the transport roller, wherein the transport roller has an elasticity that, when the belt is pressed against the transport roller, allows the belt to bite into the transport roller by a bite amount corresponding to a pressing force, the second transport unit comprises an abutting member disposed inside the belt, the abutting member comprises an upstream protrusion, an downstream protrusion, the upstream protrusion and the downstream protrusion being provided at positions away from each other at an upstream portion and a downstream portion in a sheet transport direction, each of the upstream protrusion and the downstream protrusion protruding toward an inner surface of the belt, and a recess provided in an intermediate portion between the upstream protrusion and the downstream protrusion in the sheet transport direction, the recess being recessed away from a straight line connecting a top portion of the upstream protrusion and a top portion of the downstream protrusion, the abutting member presses the belt from the inner surface of the belt and causes the belt to abut against the transport roller, a downstream pressed portion of the belt pressed by the downstream protrusion is in contact with the transport roller, and an upstream pressed portion of the belt pressed by the upstream protrusion is separated from the belt.

2. The decurling device according to claim 1, wherein the second transport unit is movable relatively to the first transport unit such that a gap between the upstream pressed portion and the transport roller is widened when the bite amount by which the downstream pressed portion bites into the transport roller is increased.

3. The decurling device according to claim 2, wherein the second transport unit changes a posture of the second transport unit in a rotation direction of the belt relatively to the first transport unit.

4. The decurling device according to claim 3, wherein the second transport unit changes a position of the second transport unit in the sheet transport direction relatively to the first transport unit.

5. The decurling device according to claim 4, wherein the second transport unit comprises a guide member having a contact surface that is in contact with the inner surface of the belt, the contact surface defining a part of a circulation track of the belt, the contact surface having an arc shape, and the upstream protrusion protrudes beyond a virtual circle obtained by extrapolating an arc of the contact surface.

6. The decurling device according to claim 3, wherein the second transport unit comprises a guide member having a contact surface that is in contact with the inner surface of the belt, the contact surface defining a part of a circulation track of the belt, the contact surface having an arc shape, and the upstream protrusion protrudes beyond a virtual circle obtained by extrapolating an arc of the contact surface.

7. The decurling device according to claim 6, wherein both the upstream protrusion and the downstream protrusion protrude beyond the virtual circle, and a length between a center point of the virtual circle and the top portion of the upstream protrusion is longer than that between the center point and the top portion of the downstream protrusion.

8. The decurling device according to claim 2, wherein the second transport unit changes a position of the second transport unit in the sheet transport direction relatively to the first transport unit.

9. The decurling device according to claim 8, wherein the second transport unit comprises a guide member having a contact surface that is in contact with the inner surface of the belt, the contact surface defining a part of a circulation track of the belt, the contact surface having an arc shape, and the upstream protrusion protrudes beyond a virtual circle obtained by extrapolating an arc of the contact surface.

10. The decurling device according to claim 9, wherein both the upstream protrusion and the downstream protrusion protrude beyond the virtual circle, and a length between a center point of the virtual circle and the top portion of the upstream protrusion is longer than that between the center point and the top portion of the downstream protrusion.

11. The decurling device according to claim 2, wherein the second transport unit comprises a guide member having a contact surface that is in contact with the inner surface of the belt, the contact surface defining a part of a circulation track of the belt, the contact surface having an arc shape, and the upstream protrusion protrudes beyond a virtual circle obtained by extrapolating an arc of the contact surface.

12. The decurling device according to claim 11, wherein both the upstream protrusion and the downstream protrusion protrude beyond the virtual circle, and a length between a center point of the virtual circle and the top portion of the upstream protrusion is longer than that between the center point and the top portion of the downstream protrusion.

13. The decurling device according to claim 1, wherein the second transport unit comprises a guide member having a contact surface that is in contact with the inner surface of the belt, the contact surface defining a part of a circulation track of the belt, the contact surface having an arc shape, and the upstream protrusion protrudes beyond a virtual circle obtained by extrapolating an arc of the contact surface.

14. The decurling device according to claim 13, wherein both the upstream protrusion and the downstream protrusion protrude beyond the virtual circle, and a length between a center point of the virtual circle and the top portion of the upstream protrusion is longer than that between the center point and the top portion of the downstream protrusion.

15. The decurling device according to claim 13, wherein at least a part of a bottom surface of the recess is a flat surface, and a distance between (i) a perpendicular line to the bottom surface passing through the center point of the virtual circle and (ii) the top portion of the upstream protrusion is longer than that between (i) the perpendicular line and (ii) the top portion of the downstream protrusion.

16. The decurling device according to claim 1, wherein the second transport unit operates such that during idle time, the bite amount by which the belt bites into the transport roller is a smaller bite amount including zero than that during use time.

17. The decurling device according to claim 16, wherein the second transport unit operates such that the entire abutting member is separated from the transport roller by a thickness of the belt or more during the idle time.

18. The decurling device according to claim 1, wherein a circumferential length of the transport roller and a circumferential length of the belt are different from each other.

19. The decurling device according to claim 1, wherein the belt is made of a polyimide.

20. An image forming apparatus comprising:

an image forming unit that forms an image on a sheet; and a decurling unit that causes the sheet on which the image has been formed to pass through the decurling unit, the decurling unit removing a curl in the sheet, wherein the decurling unit comprises the decurling device according to claim 1.

* * * * *